US010150490B2

(12) United States Patent
Stern et al.

(10) Patent No.: US 10,150,490 B2
(45) Date of Patent: Dec. 11, 2018

(54) COUPLER FOR A RAILWAY VEHICLE, CORES AND METHOD FOR PRODUCTION

(71) Applicants: Aaron Stern, West Chester, PA (US); Perry Levitt, West Chester, PA (US); Manuel Tavares, West Chester, PA (US); Zachary Ryan Brook, Leola, PA (US); Wayne H. Murphy, Pottstown, PA (US)

(72) Inventors: Aaron Stern, West Chester, PA (US); Perry Levitt, West Chester, PA (US); Manuel Tavares, West Chester, PA (US); Zachary Ryan Brook, Leola, PA (US); Wayne H. Murphy, Pottstown, PA (US)

(73) Assignee: Pennsy Corporation, West Chester, PA (US)

( * ) Notice: Subject to any disclaimer, the term of this patent is extended or adjusted under 35 U.S.C. 154(b) by 297 days.

(21) Appl. No.: 14/720,395

(22) Filed: May 22, 2015

(65) Prior Publication Data

US 2016/0339930 A1 Nov. 24, 2016

(51) Int. Cl.

| | |
|---|---|
| ***B61G 3/04*** | (2006.01) |
| ***B22C 9/10*** | (2006.01) |
| ***B22C 9/22*** | (2006.01) |
| ***B22C 9/02*** | (2006.01) |

(52) U.S. Cl.

CPC ..... *B61G 3/04* (2013.01); *B22C 9/02* (2013.01); *B22C 9/103* (2013.01); *B22C 9/108* (2013.01); *B22C 9/22* (2013.01)

(58) Field of Classification Search

CPC ... B61G 3/04; B61G 9/24; B61G 7/10; B61G 7/12; B61G 5/02; B61G 7/00

USPC ..... 213/62 R, 63

See application file for complete search history.

(56) References Cited

U.S. PATENT DOCUMENTS

| | | | | |
|---|---|---|---|---|
| 461,312 | A | 10/1891 | Brown | |
| 533,985 | A | 2/1895 | Brown | |
| 559,005 | A * | 4/1896 | Timms | B61G 9/24 213/62 R |
| 640,147 | A * | 12/1899 | McKeen | B61G 9/24 213/62 R |
| 693,998 | A | 2/1902 | Brown | |
| 1,482,751 | A * | 2/1924 | Kinne | B61G 7/10 213/62 R |
| 2,088,135 | A | 7/1937 | Johnson et al. | |
| 2,689,051 | A | 9/1954 | Kayier | |
| 3,604,569 | A | 9/1971 | Kulieke | |
| 4,081,082 | A | 3/1978 | Scherrer et al. | |
| 4,591,059 | A | 5/1986 | Hammarlund | |
| 5,320,229 | A | 6/1994 | Mautino et al. | |
| 5,511,676 | A | 4/1996 | Holmes | |

(Continued)

*Primary Examiner* — Mark T Le

(74) *Attorney, Agent, or Firm* — John F. A. Earley, III; Frank J. Bonini, Jr.; Harding, Earley, Follmer & Frailey, P.C.

(57) ABSTRACT

A coupler having a support provided through the body of the coupler and a plurality of openings in the coupler which are configured as open cavities. The coupler structure includes a shank that has a vertical support as well as lateral support. The coupler may be configured with a double I-beam structure with openings into the shank. Cores that may be fixed to the mold may be used to form the coupler and produce the openings in the shank.

45 Claims, 4 Drawing Sheets

(56) References Cited

U.S. PATENT DOCUMENTS

| | | | | |
|---|---|---|---|---|
| 5,878,897 | A * | 3/1999 | Lazzaro | B61G 3/06 213/139 |
| 5,954,212 | A | 9/1999 | Beatty et al. | |
| 6,129,227 | A | 10/2000 | Openchowski et al. | |
| 6,155,442 | A | 12/2000 | Wurzer et al. | |
| 7,302,994 | B2 | 12/2007 | Mautino et al. | |
| 7,337,826 | B2 | 5/2008 | Mautino et al. | |
| 7,757,871 | B2 | 7/2010 | Mautino et al. | |
| 8,056,741 | B2 | 11/2011 | Mautino et al. | |
| 8,196,762 | B2 | 6/2012 | Smerecky | |
| 8,201,613 | B2 | 6/2012 | Marchese et al. | |
| 8,297,455 | B2 | 10/2012 | Smyth | |
| 8,381,923 | B2 | 2/2013 | Smyth | |
| 8,408,406 | B2 | 4/2013 | Smerecky et al. | |
| 8,485,371 | B2 * | 7/2013 | Nibouar | B61G 3/04 213/100 R |
| 8,499,819 | B2 | 8/2013 | Nibouar et al. | |
| 8,544,662 | B2 | 10/2013 | Smerecky et al. | |
| 8,631,952 | B2 | 1/2014 | Smerecky | |
| 8,646,631 | B2 | 2/2014 | Marchese et al. | |
| 8,662,327 | B2 | 3/2014 | Nibouar et al. | |
| 2011/0024379 | A1 | 2/2011 | Ely | |
| 2011/0168655 | A1 | 7/2011 | Nibouar et al. | |

* cited by examiner

COUPLER FOR A RAILWAY VEHICLE, CORES AND METHOD FOR PRODUCTION

BACKGROUND OF THE INVENTION

1. Field of the Invention

This invention relates in general to railcars and, more particularly, to a railcar coupler, system, cores and method for its production.

2. Brief Description of the Related Art

Railcar couplers are disposed at each end of a railway car to enable joining one end of such railway car to an adjacently disposed end of another railway car. The engageable portions of each of these couplers is known in the railway art as a knuckle. For example, railway freight car coupler knuckles are taught in U.S. Pat. Nos. 4,024,958; 4,206,849; 4,605,133; and 5,582,307.

Typically, adjacent railway cars are joined by heavy shafts extending from each car, known as couplers, and, generally, each coupler is engaged with a yoke housing a shock-absorbing element referred to as the draft gear. The type-E coupler is the standard coupler for railway freight cars. The type-E coupler has standard specifications such that producers making a type-E coupler adhere to a standard specification, so that the standard railway car couplers are completely interchangeable, regardless of the manufacturer. In addition, adherence to a standard also enables couplers from any one manufacturer to be able to be readily joined to couplers from any other domestic manufacturer. The Association of American Railroads ("AAR") has adopted standards for railway couplers. The coupler must include specific geometry and dimensions that allow it to receive a knuckle, and the geometry must be such that the knuckle is allowed to freely operate when coupling and uncoupling railway cars. These dimensions and features of the coupler may be checked for compliance with AAR standards by using gauges, which are applied to the coupler to verify the coupler dimensions or parameters are within an allowable variation or tolerance range.

Couplers have a particular life, and in instances may fail. In many cases when a railcar coupler fails, it is difficult to replace it, since, typically, the repair or replacement must be done in a repair shop.

The production of couplers typically involves a method known as sand casting or "green sand" method, where a flask which is a box having an open top and open bottom, is filled with sand around a pattern which is a component (such as, for example, a piece made from wood or iron) that is used to make the impression in the sand. The green sand casting process involves a number of components and steps, as a flask or box must be created with cope and drag sections, so that the pattern may make an impression in the sand and can be removed from the mold prior to introduction of the molten metal therein. A mold may include additional components, such as, for example, a gate and one or more runners through which the molten metal is admitted to one or more parts of the impression formed by the pattern. Gates and runners generally are formed similar to the mold impression, for example, with a component, such as wood (e.g., a gate and runner pattern), and are removed prior to the introduction of the molten metal, often with the removal of the pattern. A path of entry, such as an opening for admission of molten material is generally made through a sprue which is a communication path leading to the gate. The gate generally receives the molten metal that is poured through the sprue opening, and the runners act as conduits through which the molten metal flows to the impression or mold space formed by the pattern. In the case of forming a coupler, the mold must further be provided with cores. Cores are generally made from a material that remains present in the molding process during the mold melt introduction and are removable thereafter. In some cases, such as, for example, in the case of a coupler shank, the configuration of the pattern or ultimate coupler part does not allow for removal of a core in its solid form, so the core must therefore be broken apart and removed in pieces. The cores generally also may be made from green sand. The "green sand" method involves baking the mold so that the sand will form a mass and stay together during the molding process, and, in particular, when the molten metal is introduced into the mold. Once the molten metal is introduced into the mold through the sprue, gate and runners, the molten metal flows around the open areas of the mold and is blocked from entry to areas of the mold that are occupied by cores. The placement and positioning of cores in the mold, as well as the ability for a core to remain in place is required in order to produce a usable coupler. Although attempts are made to secure the core in a proper position, the cores have been known to shift prior to or during receiving the melt. In instances where a core shifts or where the green sand is not completely amassed together (e.g., where portions break off leaving fractured or missing edges), the coupler produced may need to be scrapped. However, in many instances the core shift occurs and is not detectable. For example, in some instances, core shift may lead to a variation in the wall thicknesses, where the wall is incorrectly formed. These types of defects are not always apparent by external inspection, particularly for a defect in an internal wall, and, if present, can lead to premature failure of the coupler.

Couplers, in operation on a railway vehicle, are subjected to forces, including torque. These loads put strain on the coupler.

A need exists for a coupler that has an improved construction for handling force loads and which may be manufactured in a manner that minimizes or eliminates the potential for misformed structures.

SUMMARY OF THE INVENTION

The present invention provides a railcar coupler, system and method for producing couplers, that substantially eliminates or reduces at least some of the disadvantages and problems associated with previous couplers and production methods.

In accordance with a particular embodiment, a railcar coupler includes a coupler head portion extending from a shank portion. The coupler head portion is configured to couple to a first coupler knuckle for coupling the railcar coupler to a second railcar coupler of an adjacent railcar. The coupler head portion comprises a nose portion and a gathering face extending from the nose portion for engaging a second coupler knuckle coupled to the second railcar coupler. The coupler head portion comprises a guard arm portion extending from the nose portion.

A coupler having improved strength and force handling characteristics, where a support is provided through the body of the coupler, and where openings are provided in the coupler. The coupler structure preferably includes a vertical support as well as a lateral support. According to a preferred embodiment, the coupler is constructed to have outer walls, such as upper and lower walls, that form an arrangement with a wall forming the coupler body. In a preferred embodiment, the coupler structure has a vertical wall that connects the upper and lower walls with the wall disposed in the coupler body.

According to preferred embodiments, the coupler structure includes walls forming an I-beam configuration, and more preferably, a double I-beam configuration.

According to preferred embodiments, the coupler outer walls and wall disposed in the coupler body, along with a vertical wall, form an I-beam configuration, and more preferably, a double I-beam configuration.

According to some preferred embodiments, the coupler is formed with supporting walls or ribs. The ribs or supporting walls may connect with walls forming the I-beam structure, and, in addition, may form a portion of the I-beam, such as, for example, with the vertical wall. According to some embodiments, the walls or ribs form a lateral extension of the vertical wall.

According to a preferred embodiment, the double I-beam structure is formed from three horizontal walls extending through the shank prior to the key slot and, after the key slot, through the shank butt, and a vertical wall. In preferred embodiments, the vertical wall may extend continuously along the centerline of the shank, with the exception of the key slot (which remains uninterrupted). A plurality of reinforcement ribs also are provided between the horizontal walls. The ribs improve the torsional rigidity of the coupler shank, and provide the coupler with improved strength. According to preferred embodiments, the ribs preferably are recessed inwardly from the edges of the horizontal walls.

The present coupler has improved strength and force handling compared with traditional couplers. A traditional coupler typically has a shank or body portion with a relatively box-like configuration (e.g., in cross-section, as shown in prior art FIG. 13, which illustrates a sectional view of a prior art coupler shank). The torque handling and linear force load handling are improved by the present coupler. The prior coupler structures are more susceptible to being strained when a torque force is applied. The coupler structure of the present invention preferably is configured to improve resistance to torque and horizontal forces and provide a coupler that has improved stability and force handling when loads are received on the coupler. The improved configuration, such as, for example, the double I-beam structure of the preferred embodiments, improves resistance to moments from horizontal forces (which typically is the strongest load applied to a coupler). Preferred embodiments may also include reinforcing ribs which add torsional rigidity to the configuration, and more particularly the I-beams, making the shank equally resistant to torque forces.

According to some embodiments, the coupler shank may have the improved structure at the shank front portion (which may be referred to as the shank mid portion) that is forward of the key slot, or at the shank end portion, which is after the key slot, or more preferably, at both locations.

According to preferred embodiments, a plurality of openings, which may be recesses, are provided in the coupler, and, in preferred embodiments, are provided on both sides of the coupler and extend from the coupler outer boundary to an inner vertical wall, such as, for example, a vertical wall connecting the upper, lower and mid walls. The recesses may be divided, in whole or part, by additional walls, which may be referred to as support walls or ribs.

The configuration of the couplers produced in accordance with the invention allows for advantages in the manufacturing process to have greater control of dimensions and material thickness, as well as the integrity of the coupler formed. According to a preferred method, couplers of the invention may be formed using coring that can be fixed or locked into the cope and/or drag of the mold. The prior art hollow shank design used a large core that was, by comparison, unsupported and prone to core shift. As discussed above, core shift typically leads to incorrect wall thicknesses which are not apparent by external inspection, and may lead to premature failure of the part. According to a preferred embodiment, the coupler mold may comprise mold parts, such as cope and drag mold sections, which may carry the cores in a fixed position. The fixing of at least some of the cores provides the ability for the coupler openings or recesses to be produced without the tendency to shift, since the cores forming the openings or recesses are locked to the mold sections (such as, for example, the cope and drag sections of a mold). According to some preferred embodiments, the cores forming the coupler shank may be fixed to the mold, and, may, for example, form the openings in the shank, the shank walls, shank end portion and key slot.

An object of the invention is to provide an improved method and mold for producing a coupler with cavities (also referred to as openings) in the coupler structure, where the cores forming the cavities are fixed to the mold or mold parts. According to some preferred embodiments, the coupler shank is formed with cavities using fixed core structures. This process improves the production of the coupler. In addition, couplers produced using the method and core structure may have improved force handling properties, such as, for example, the ability to handle torque forces.

Another object of the invention is to produce a coupler that is suitably strong, being as strong as or stronger than existing couplers, and which may be constructed to save weight by reducing the amount of material required for its production.

In addition, embodiments of the coupler preferably may be provided to have specified wall thicknesses. According to some preferred embodiments, the wall thickness range may be from about 0.25 to about 3.0 inches. Whereas prior couplers typically have wall thicknesses of 4 inches at the shank end, the present coupler provides a structure which significantly reduces wall thickness. An object of the invention is to reduce material thickness, while providing a coupler that is equal to or greater in strength than those prior couplers whose wall thickness maximized at 4 inches. Another object is to provide a coupler that has walls, that include at least some wall thicknesses that have thicknesses as small as 0.25 inches, or 0.5 inches. For example, a coupler may be produced having a minimum wall thickness where the guard arm wall (e.g., the wall forming the gathering face) may be 0.5 inches or less, and wherein the shank of the coupler has walls that are 0.5 inches or less, which may include the shank mid portion, the shank end portion, or both.

According to one preferred embodiment, the coupler shank upper and lower walls have a thickness of about 0.5 to 2.0 inches, the vertical wall has a thickness of about 0.5 to 2.0 inches, and the mid wall has a thickness of about 0.5 to 2.0 inches. According to another preferred embodiment, the horizontal wall of the guard arm preferably has the same thickness as the mid wall of the shank.

It is an object of the invention to provide an improved coupler that has one or more of the improved characteristics or features, including combinations of one or more of the features. For example, the coupler may be provided with a plurality of openings in the coupler head, as well as in the coupler shank. The mid wall or lateral support may be provided along the coupler length, including, for example, in the coupler head and shank portions.

According to some embodiments, the coupler may be constructed from steel, such as Grade E steel, or alternatively, may be constructed from austempered metal. In a preferred embodiment, the austempered metal is austempered ductile iron (ADI). In another preferred embodiment the austempered metal is austempered steel, such as austempered alloy steel, and, according to other embodiments the coupler may be constructed from an austempered metal alloy.

Austempered ductile iron (ADI) is produced by a suitable austempering process. For example, austempering of ductile iron may be accomplished by heat-treating cast ductile iron to which specific amounts of nickel, molybdenum, manganese or copper, or combinations thereof have been added to improve hardenability; the quantities of the elements needed to produce the ADI from ductile iron are related to the coupler configurations and, for example, may depend on the thickest cross-sectional area of the coupler. Austempered steel and other austempered metals and austempered metal alloys, may be produced by any suitable austempering process, including producing a ductile iron casting of the coupler (to which the alloyed elements have been added), and austempering the casting.

BRIEF DESCRIPTION OF THE DRAWING FIGURES

DETAILED DESCRIPTION OF THE INVENTION

Referring to FIGS. 1-7 and 9, there is illustrated a preferred embodiment of a railway vehicle coupler 10 for freight railway cars in accordance with a preferred embodiment of the invention. The coupler 10 may be produced using any suitable method, including casting, and according to a preferred method, a casting of the coupler is produced using mold components that have cores secured thereto. According to some embodiments, couplers according to the invention may be constructed to meet standard specifications as set forth by the Mechanical Committee of Standard Coupler Manufacturers and/or other standards, including AAR standards.

Figure 13:
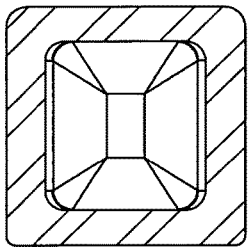
PRIOR ART Figure 13
FIG. 13 is a sectional view of a prior art coupler shank, the section being taken vertically through the shank.
Figure 8:
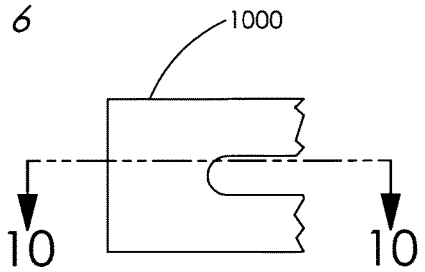
PRIOR ART Figure 8
FIG. 8 is a partial, right side elevation view of a prior art coupler, showing the shank end of the coupler apart from the other portions of the coupler.
Figure 10:
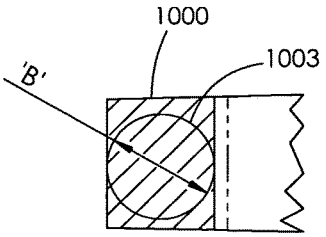
PRIOR ART Figure 10
FIG. 10 is a sectional view of the prior art coupler of FIG. 8, taken along the line 10-10 of FIG. 8.

FIGS. 8, 10 and 13 illustrate an example of a prior art coupler 1000 that has a generally box-like shank cross-section.

The coupler 10 is mounted within a yoke (not shown) secured at each end of a railway car center sill, such that, in accordance with a preferred mounting arrangement, the coupler 10 may extend outwardly under an end of a railway car to engage a similar coupler (or any compatibly connectible coupler) extending outwardly under an end of an adjacent railway car. Coupler 10 includes a shank 14 having a bore or key slot 58 which is adapted to connect to the yoke (not shown) on the end of a center sill of a railway vehicle. The generally V-shaped coupler head 13 is provided at a forward end extending from the shank 14. The shank 14 is adapted to be fitted within and attached to a yoke secured at each end of a center sill extending full length under the railway car at a longitudinal axis. The coupler head 13 is provided to receive a vertical-knuckle (not shown) rotatably pinned at an outer end of the coupler head 13 forming a first leg of the coupler head 13, while a second leg of the coupler head 13 comprises a fixed and rigid guard arm portion 16.

Figure 2:
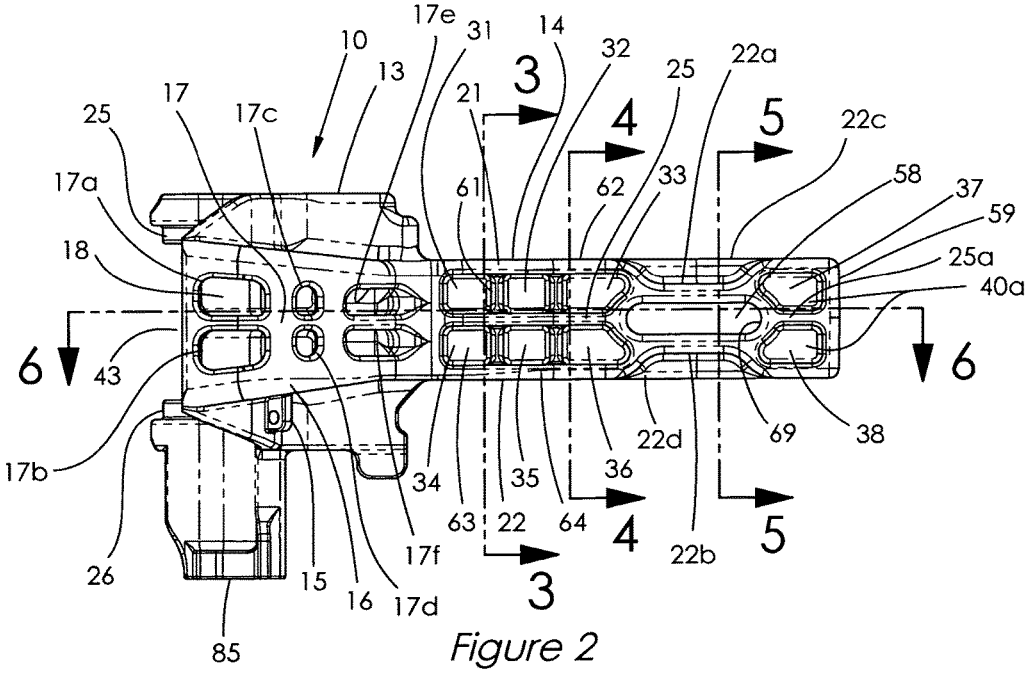
FIG. 2 is a left side elevation view of the coupler of FIG. 1.

The coupler head 13 further includes pivot pin openings, including an upper pivot pin opening 23 and a lower pivot pin opening 24, and pivot lugs, including an upper pivot lug 23*a* and a lower pivot lug 24*a*. The pivot pin openings 23,24 are provided to receive a knuckle pin (not shown) which is installed in the pivot pin openings 23,24 when a knuckle is seated at the pivot lugs 23*a*,24*a*. The pivot lugs 23*a*,24*a* and pin, when installed, pivotally retain a knuckle on the coupler head 13. The coupler head 13 preferably is configured with the pivot lugs 23*a*,24*a* aligned with the respective pivot openings 23,24. Referring to FIG. 2, the coupler 10 also includes a chain lug 15 provided on the coupler head 13. Although the chain lug 15 is shown located below the guard arm 16, according to some alternate embodiments, chain lugs in some couplers may be located on a coupler lock chamber.

Figure 1:
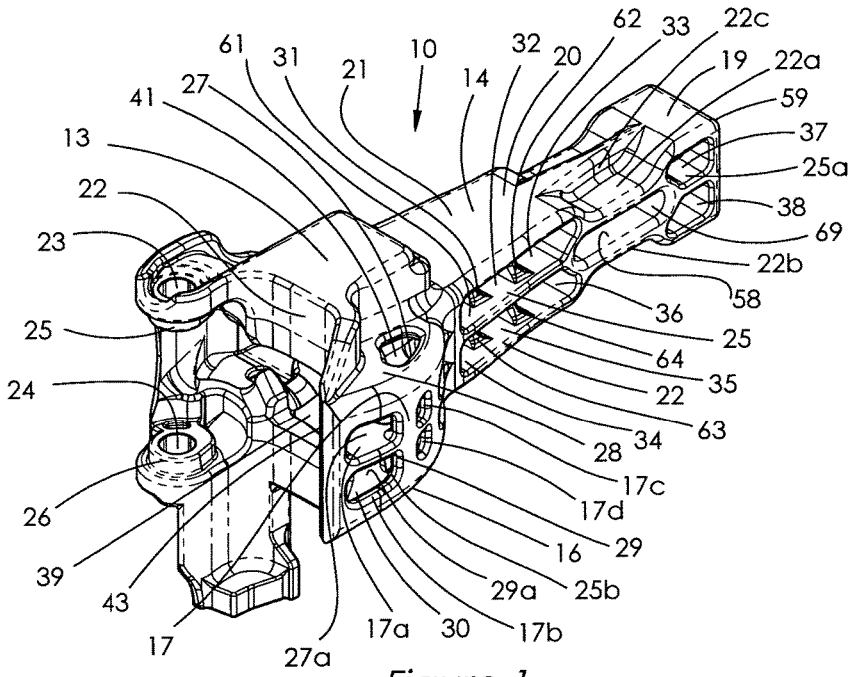
FIG. 1 is a perspective view of an exemplary embodiment of a coupler according to my invention.
Figure 6:
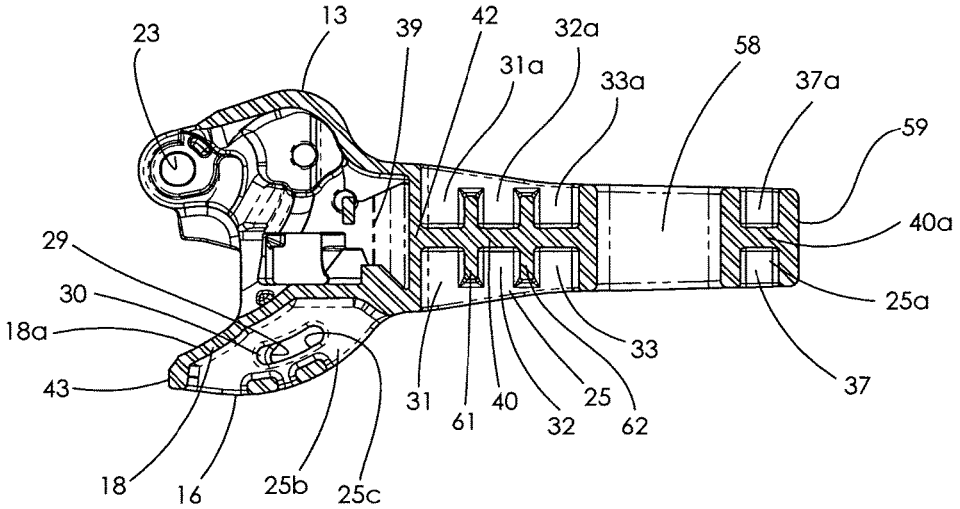
FIG. 6 is a sectional view of the coupler of FIG. 1, the section being taken through the length of the coupler, along the section line 6-6 of FIG. 2.

The coupler 10 also is shown having a first angled gathering surface 18*a* (FIG. 6) provided on the gathering wall 18 of the coupler head 13. According to the preferred embodiment illustrated, the coupler 10 has a plurality of cavities. The coupler 10 is shown having a plurality of cavities provided in the guard arm 16. The coupler head 13, provided at the front of the coupler 10, is shown having a guard arm 16 with a first plurality of cavities provided in the guard arm 16, which include an upper cavity 27*a* and a lower cavity 29*a*. A plurality of openings preferably are provided in the head 13. Referring to FIGS. 1, 2 and 6, an upper opening 27 is provided in the top surface or upper wall 28 of the guard arm 16. According to a preferred embodiment, a lower opening 29 is provided in the guard arm lower surface or bottom wall 30 (FIG. 6). The cavities 27*a*,29*a* may be defined by one or more interior walls, such as for example, the inner cavity side wall 41 (FIG. 1) and gathering face wall 18 (FIG. 2), as well as by the upper wall 28 and lower wall 30. The openings 17*a*,17*b*,17*c*,17*d*,17*e*,17*f* in the guard arm side wall 17 preferably are bordered by a portion of the side wall 17. The upper and lower guard arm cavities 27*a* and 29*a*, respectively, preferably form the guard arm interior space.

According to a preferred embodiment, the coupler 10 is constructed with a mid wall portion 25*b* spanning between the gathering face wall 18 and the guard arm side wall 17. The mid wall portion 25*b* preferably, along with the upper wall 28, defines the upper cavity 27*a* and with the lower wall 30 defines the lower cavity 29*a*. The mid wall portion 25*b*, as shown in the embodiment illustrated in FIG. 6, preferably includes an opening 25*c* therein providing communication between the upper cavity 27*a* and lower cavity 29*a*.

According to a preferred embodiment illustrated, the guard arm 16 of the coupler 10 extends from the coupler nose portion 43 to the rear of the coupler head 13 where the coupler head joins with the shank 14. The coupler 10 includes a front face 22 and has a cavity 39 within which the knuckle operating components, such as a lock, thrower and lift, may be situated (when a knuckle is installed on the coupler). According to a preferred embodiment, the head 13 joins with the shank 14 at a front wall 42 (FIG. 6).

Figure 5:
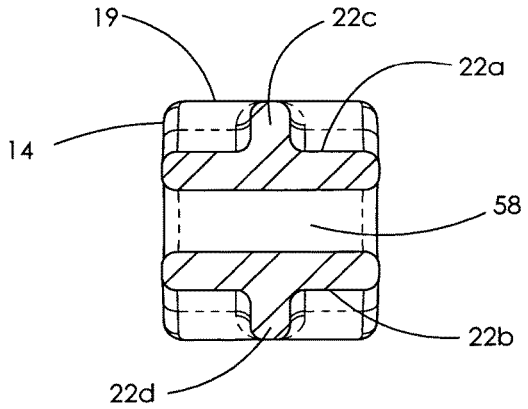
FIG. 5 is a sectional view of the coupler of FIG. 1, the section being taken through the key slot of the shank, along the section line 5-5 of FIG. 2.

The coupler shank 14 has a shank end portion 19 and a shank mid portion 20. The shank mid portion 20 connects the head 13 with the shank end portion 19. Referring to FIG. 2, the coupler has an upper wall 21 provided on the shank 14 that spans from the head 13 to the shank end portion 19. The coupler 10 also has a lower wall 22, provided on the shank 14 and spanning from the head 13 to the shank end portion 19. According to a preferred embodiment, the coupler 10 includes a recessed portion at the shank 14. As shown in a preferred embodiment, referring to FIGS. 1, 2 and 5, the coupler 10 includes an upper recess 22*a* and lower recess 22*b* provided in the shank 14 at the location of the key slot 58. According to a preferred embodiment, the upper recess 22*a* includes a longitudinal rib 22*c* spanning from the shank mid portion 20 to the shank end portion 19. The lower recess 22*b* also preferably includes a longitudinal rib 22*d* (FIGS. 2 and 5).

Figure 7:
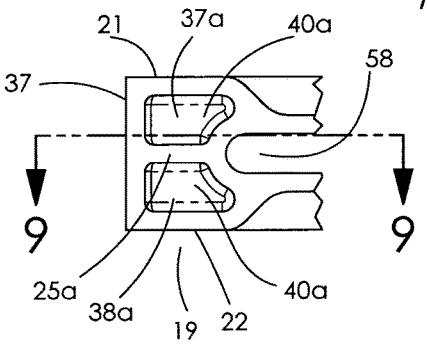
FIG. 7 is a partial, right side elevation view of the coupler of FIG. 1, showing the shank end of the coupler apart from the other portions of the coupler.
Figure 9:
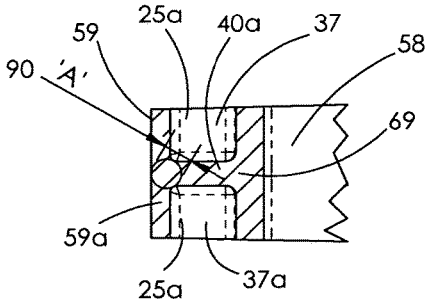
FIG. 9 is a sectional view of the coupler shank end shown in FIG. 7, taken along the line 9-9 of FIG. 7.

In the preferred embodiment illustrated, the upper wall 21 and lower wall 22 form opposite exterior walls of the coupler 10. A mid wall 25 is disposed between the upper wall 21 and lower wall 22. According to a preferred embodiment, a plurality of openings are provided along the coupler shank mid portion 20. According to a preferred arrangement, the openings 31,32,33,34,35,36 are provided in the mid shank portion 20. Preferably, there are openings provided on the opposite side of the coupler 10 similar to the openings 31,32,33,34,35,36 but on the other side of the vertical wall 40. Opposite openings 31*a*,32*a*,33*a* are shown in FIG. 6. (and while not shown, preferably there are openings below the mid wall 25 below the openings 31*a*,32*a*,33*a*, on the opposite side of the vertical wall 40 opposite the openings 34,35,36). According to a preferred embodiment, the openings on the far side of the coupler (which are shown, in part, to include those openings 31*a*,32*a*,33*a* (FIG. 6) and openings 36*a* (FIG. 4), 37*a*,38*a*, (FIG. 9)) may be symmetrical to the openings 31,32,33,34,35,36 and 37,38. Openings 37,38, 37*a*,38*a* are provided in the shank end portion 19. Referring to FIGS. 6, 7 and 9, a vertical wall 40*a* is shown separating the openings 37,38 from openings 37*a*,38*a* on the opposite side of the wall 40*a*. A mid wall 25*a* of the shank end separates the openings 37,38. According to preferred embodiments, the openings, which preferably include the mid shank openings 31,32,33,34,35,36 and the shank end openings 37,38 (and those openings on the opposite side of the wall 40 and 40*a*) extend into the coupler 10 and are located between the upper wall 21 and the lower wall 22.

Figure 3:
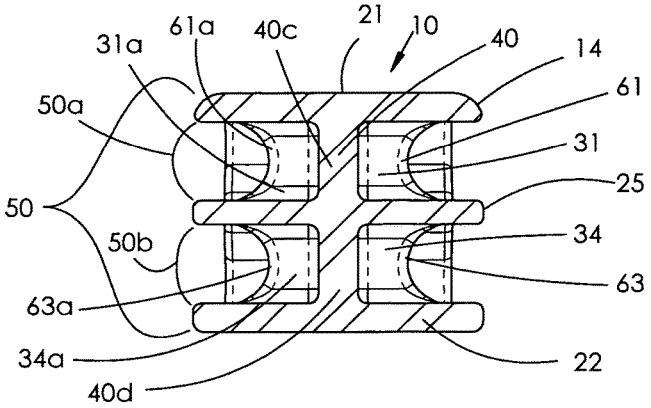
FIG. 3 is a sectional view of the coupler of FIG. 1, the section being taken along the section line 3-3 of FIG. 2.
Figure 4:
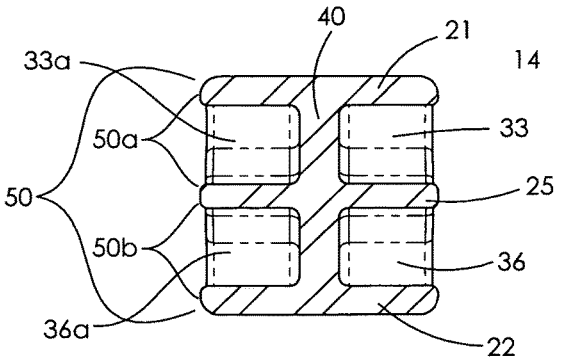
FIG. 4 is a sectional view of the coupler of FIG. 1, the section being taken through the shank, along the section line 4-4 of FIG. 2.

According to a preferred embodiment, the mid wall 25 connects with the upper wall 21 and lower wall 22. A preferred arrangement for the connection of the mid wall 25 is shown being configured as a double I-beam 50, as shown in FIGS. 1, 2 and 6, and in the sectional views of FIGS. 3 and 4. Referring to FIG. 3, the upper wall 21 is shown forming the upper wall 21 of the double I-beam 50. The lower wall 22 is shown forming the lower wall 22 of the double I-beam 50. The mid wall 25 forms a first I-beam 50*a* with the upper wall 21 and a second I beam 50*b* with the lower wall 22. FIG. 4 also shows a double I-beam configuration, where the double I-beam is configured from the lower wall 22, upper wall 21, mid wall 25 and vertical wall 40.

In the embodiment shown, the double I-beam structure 50 has a first leg 40*c* extending between the upper wall 21 and the mid wall 25, and a second leg 40*d* extending between said mid wall 25 and lower wall 22. In the embodiment illustrated, the double I-beam structure 50 is formed by the first leg 40*c* and second leg 40*d*, and the first and second legs 40*c*,40*d* are aligned in a linear relationship. In a preferred embodiment, the first leg 40*c* is aligned with the second leg 40*d*, so that the legs lie in the same plane. According to a preferred embodiment, the upper openings 31,32,33 may be provided similar in depth and configuration as the lower openings 34,35,36. Similarly, the openings on the opposite side of the wall 40 (such as those 31*a*,32*a*,33*a* which are shown in FIG. 6, 34*a* shown in FIG. 3, and 36*a* shown in FIG. 4) may be provided in a similar configuration, for example, to be symmetrical with the openings 31,32,33,34, 35,36.

According to an alternate embodiment, the first leg 40*c* and said second leg 40*d* may be aligned in a parallel relationship, although not necessarily in a linear relationship. The double I-beam structure may be provided in the mid shank 20 and the shank end portion 19. Alternatively, the mid wall may form a plurality of double I-beam structures in the shank mid portion, where the mid-wall forms a portion of each double I-beam structure. The double I-beam structure has a first I-beam portion with an upper horizontal portion and a lower horizontal portion and a second I-beam portion with an upper horizontal portion and a lower horizontal portion. The upper wall comprises the upper horizontal portion of the first I-beam portion of the double I-beam. The lower wall comprises the lower horizontal portion of the second I-beam portion. The mid wall forms the lower horizontal portion of the first I-beam portion of the double I-beam with the upper wall. The mid-wall forms the upper horizontal portion of the second I-beam portion of the double I-beam with the lower wall.

According to an alternate embodiment, the vertical wall 40 may be formed with locations there along, such as for example, legs, like those legs 40*c*,40*d*, shown in FIG. 3, but with the legs having an increased width, so the leg width is larger than the width of the wall 40.

Figure 11:
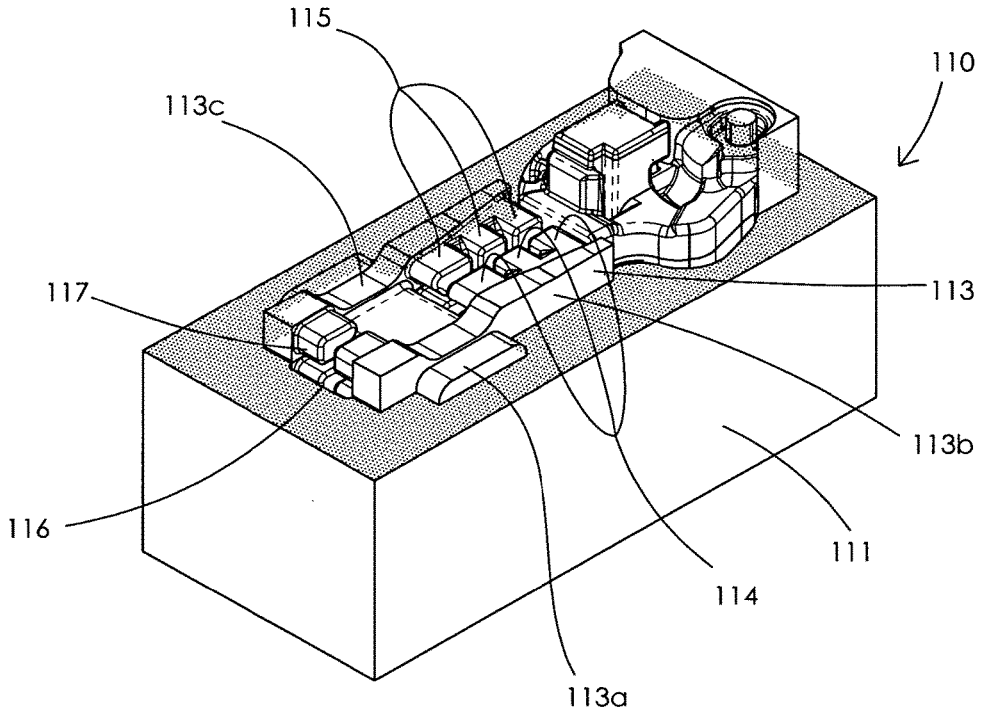
FIG. 11 is a perspective view showing a mold according to the invention.
Figure 12:
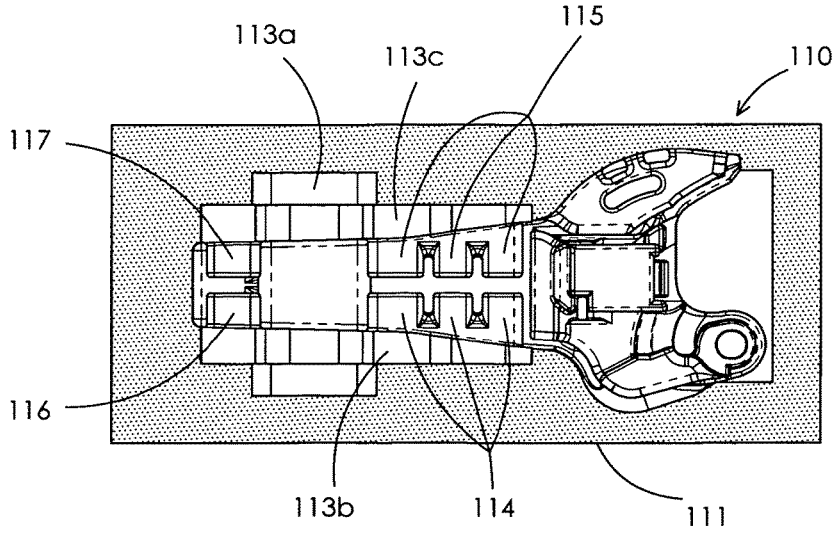
FIG. 12 is a top plan view of the mold of FIG. 11.

According to a preferred embodiment, a plurality of supporting walls or ribs are provided, and preferably there are walls or ribs provided on each side of the vertical wall 40 of the coupler mid shank 20. Referring to the sectional view of FIG. 6, according to one embodiment, ribs 61,62, 63,64 are provided between the horizontal walls of the shank, and are shown between the upper wall 21, mid wall 25 and lower wall 22. Preferably, the walls or ribs 61,62, 63,64 connect with the vertical wall 40 and the mid wall 25, and more preferably, also with one of the respective upper or lower walls 21,22. A preferred arrangement of the rib configuration is illustrated in the coupler embodiment shown in FIGS. 1-7. The ribs 61,62,63,64 provide improved stability of the coupler 10 when receiving, handling and transmitting force loads. According to preferred embodiments, ribs, such as, for example, the ribs 61,62,63,64, are disposed outwardly from the vertical wall 40, and preferably may be formed with cores keyed to correspond with the openings and rib configuration, and which may be connected to the mold parts. The cores may be fixed to the mold parts to eliminate or limit movement thereof during the molding process, and the cores may be configured to provide the depth of the openings and thickness of walls. An exemplary embodiment of a preferred mold used for producing the coupler 10 is illustrated in FIGS. 11 and 12.

In a preferred configuration, the mid wall, which is illustrated comprised of portions 25,25*b*,25*a*, spans from the head 13 and through the shank 14 to the shank end 19 at the end 59 of the coupler 10. According to a preferred embodiment illustrated, the coupler head 13 has an upper wall 28, a lower wall 30 and a front segment of the mid wall 25*b*. The coupler shank 14 is shown having an upper wall 21 and lower wall 22 at the shank mid portion 20 and at the shank end 19, with the rear segment of the mid wall 25*a* disposed between the upper and lower walls 21,22. According to a preferred embodiment, the mid wall 25 at the shank mid portion 20, the front mid wall segment 25*b* and rear mid wall segment 25*a* are longitudinally aligned.

A key slot 58 is provided in the shank 14 of the coupler 10. The key slot 58 extends through the width of the coupler 10. The mid wall 25 preferably is interrupted by the key slot 58, and there is a mid wall portion or segment 25*a* at the rear of the key slot 58, and a mid wall portion 25 at the front of the key slot 58. The coupler key slot 58 is provided transversely through the shank 14. The mid wall 25 is shown having a mid wall portion 25 between the coupler head 13 and the key slot 58 and another mid wall portion 25*a* between the key slot 58 and the coupler end 59. According to some preferred embodiments, a mid wall 25*b* is provided in the coupler head 13. Preferably, the mid wall 25 and respective mid wall head and shank end portions 25*b*,25*a* may be aligned horizontally, and may form a plane through the coupler length.

According to preferred embodiments, the wall 40 preferably may be configured as a longitudinal vertical wall 40 which is provided at the mid shank 20 and at the shank end portion 19. The wall portion 40*a* at the shank end portion 19 is shown in FIGS. 6, 7 and 9, dividing the shank end portion 19 into a plurality of cavities, which include openings 37,38 (FIGS. 1 and 2), openings 37*a* (FIGS. 6 and 9) and opening 38*a* (FIG. 7).

In addition to the openings shown provided in the coupler shank 14 (and openings referred to on the opposite shank side), openings preferably are provided in the coupler head 13. According to preferred embodiments, the coupler head openings may include openings in the guard arm 16. The embodiment illustrated includes, for example, openings 17*a*, 17*b*,17*c*,17*d*,17*e*,17*f* formed in the side wall 17 of the guard arm 16. The guard arm upper wall 28 is shown having an opening 27. Referring to FIGS. 1 and 6, mid wall 25*b* is shown at the guard arm 16 and having an opening 25*c* therein. The guard arm 16 preferably has a lower wall 30 that also may have an opening 29 therein.

The coupler head 13 preferably is configured to couple to a coupler knuckle for coupling the railcar coupler 10 to a second railcar coupler (which may be another coupler 10 or other compatible coupler) of an adjacent railcar. The coupler 10 preferably carries a pivotally mounted knuckle (not shown). The knuckle preferably connects with a knuckle of a coupler on an adjacent railcar. In the embodiment illustrated, the coupler head 13 has a nose portion 43 and a gathering face 18*a*. The gathering face 18*a* extends from the nose portion 43 for engaging a second coupler knuckle that is carried by a second railcar coupler (not shown). The gathering face 18*a* is on a wall 18 of the coupler guard arm 16 (see FIG. 1).

According to preferred embodiments, the coupler 10 preferably has walls forming it that have thicknesses between about 0.25 and 3.0 inches. The coupler upper wall 21 and lower wall 22 may be constructed having thicknesses between 0.25 and 3.0 inches. In addition, the mid wall 25 (and mid wall portions 25*a*,25*b*) also may be constructed having thicknesses between 0.25 and 3.0 inches. Preferably, the vertical wall 40, as well as the end wall portion 40*a* may be constructed having thicknesses between 0.25 and 3.0 inches. The guard arm 16 and gathering face wall 18 may have thicknesses between 0.25 and 3.0 inches. According to a preferred embodiment, the coupler 10 may be constructed such that each of the wall thicknesses of the upper wall 21, lower wall 22, mid wall 25, vertical wall 40 and guard arm gathering face wall 18 and guard arm outer wall 17 have thicknesses that are between 0.5 and 2.0 inches. According to some preferred embodiments, the mid wall portions 25*a*,25*b* also may be constructed with wall thicknesses that are the same as the wall thickness of the mid wall 25.

According to preferred embodiments, the coupler 10 is made from austempered ductile iron. The austempered ductile iron may be made from ductile iron alloyed with one or more metals selected from the group consisting of nickel, molybdenum, manganese, copper and mixtures thereof. The ductile iron is alloyed with one or more of the metals and is austempered along with one or more of those metals to produce the coupler 10, which, according to preferred embodiments, is an austempered ductile iron coupler.

The coupler 10 may be formed using any method known. One preferred method for forming the coupler 10 includes the use of a mold. The mold may have cope and drag parts, and cores that stand in for spaces. Specifically, the coupler 10 may be produced in a mold cavity within a casting box between cope and drag sections. Sand, such as green sand, may be used to define the interior boundary walls of the mold cavity, and in the production of the coupler 10, a preferred mold may use green sand for the guard arm cavities, whereas cores may be used to produce the openings in the coupler shank. A preferred method involves producing a mold that corresponds with the shape of the coupler 10. The mold produced preferably has two or more mold parts, which may include the cope and drag sections of the mold (mold halves), and one or more cores, which are pieces placed into the mold cavity to take up space and produce a void during the molding process. One production method involves sand casting or a "green sand" method. A flask, which is a box having an open top and open bottom, is filled with sand around a pattern which is a component (such as a wood piece shaped to correspond with the coupler 10 to be formed) that is used to make the impression in the sand. The green sand casting process includes creating a flask or box, which may be done by creating cope and drag sections, so that the pattern may make an impression in the sand and the pattern can be removed from the mold prior to introduction of the molten metal therein. The mold may include additional components, such as, for example a gate and one or more runners through which the molten metal is admitted to one or more parts of the impression formed by the pattern. Gates and runners preferably may be formed similar to the mold impression, for example, with a component, such as wood (e.g., a gate and runner pattern), and are removed prior to the introduction of the molten metal, often with the removal of the pattern. A path of entry or other opening for admission of molten material is made to introduce the molten metal into the mold space formed by the pattern. The molten metal may be introduced through a sprue which is a communication path leading to the gate. The gate generally receives the molten metal that is poured through the sprue opening, and the runners act as conduits through which the molten metal flows to the impression or mold space formed by the pattern. In the case of forming the coupler 10, the mold must further be provided with cores. Cores are generally made from a material that remains present in the molding process during the mold melt introduction and are removable thereafter. According to a preferred embodiment, cores are provided on each side of the mold and extend into the openings on each side of the coupler 10 to block the open spaces of the coupler 10 (such as, for example, the openings 31,32,33,34,35,36,37,38 and those on the opposite side). In some cases, the configuration of the pattern or ultimate coupler part does not allow for removal of a core in its solid form, so it must therefore be broken apart and removed in pieces. According to a preferred embodiment, the coupler 10 is constructed with openings in each side thereof, so that the core may be readily removed by separating it from the coupler without the need to brake the core. According to a preferred embodiment, the cores may be used to form openings and walls in the shank, without the need to break up the core during its removal from the mold (or for removal of the part). The cores generally also may be made from green sand. The "green sand" method involves baking the mold so that the sand will form a mass and stay together during the molding process, and, in particular, when the molten metal is introduced into the mold. However, according to preferred embodiments, the cores of the present invention that may be used for forming the openings and walls of the coupler may be made from something other than green sand where the cores are not required to be broken during the molding process. Once the molten metal is introduced into the mold through the sprue, gate and runners, the molten metal flows around the open areas of the mold and is blocked from entry to areas of the mold that are occupied by cores. In the present method for forming the coupler 10, a preferred arrangement is that the openings 31,32,33,34,35,36,37,38 are blocked by one or more cores, and the openings in the guard arm 16 also preferably are blocked by cores (as may be the internal spaces 27*a*,29*a* in the guard arm 16 above and below the guard arm mid wall portion 25*b*). The placement and positioning of cores in the mold, as well as the ability for a core to remain in place are required in order to produce a usable coupler. The use of cores that may be placed on each side of the coupler and extend into the mold space (that is, the space used to form the coupler) improves the molding and reduces the tendency of the cores to shift during molding when receiving the hot melt. The improvement in the coupler and mold design may reduce instances where the core shifts and the resultant coupler is improperly formed and may need to be scrapped. The mold of the present invention includes a mold for forming the coupler, where the mold has a mold cavity corresponding to the coupler shape. The mold preferably includes a plurality of mold parts, such as, for example, one more cores for forming openings on each side of the coupler shank (which may include the openings in the mid shank and shank end portions), and in the guard arm portion. The mold preferably is configured to produce walls of the coupler that have wall thicknesses from about 0.25 inches up to about 3 inches.

Referring to FIGS. 11 and 12 a preferred embodiment of a mold 110 for forming a coupler 10 according to the invention is illustrated. The mold 110 includes a first mold part 111 and a second mold part (not shown), which are referred to, respectively, as drag and cope sections. The second mold part or cope (not shown) is brought together with the first mold part 111 or drag, so that the mold parts and any cores form the coupler shape or volume. The mold 110 is shown to illustrate the preferred embodiment of a core structure for producing the coupler 10, and more particularly for producing an improved shank with the openings. The mold 110 includes a core structure 113 for forming the shank (such as the shank 14 shown and described herein). According to a preferred embodiment, the core structure 113 preferably comprises a plurality of cores or components. The core structure 113 preferably is fixed to the mold parts so that the core structure 113 does not shift independently from the mold 110. According to a preferred embodiment, the core structure 113 forming the coupler shank (such as the shank 14 shown and described herein) includes a plurality of cores. According to a preferred embodiment, the plurality of cores forming the shank may include five cores. A key slot core 113*a*, and four cores for the side openings of the shank are provided, the upper cores 113*b*,113*c* being shown, and the lower cores forming the lower openings (such as those openings 34,35,36 and 34*a*,36*a*) being hidden within the drag 111. The right side upper core 113*b* is shown having a plurality of fingers or projections 114 that form the ribs or walls of the coupler, and the left side upper core 113*c* is shown having a plurality of projections 115 which oppose the projections 114 of the opposing core 113*b*. The projections 115 form the upper ribs or walls (such as, for example, those ribs 61,62). The cores 113*b*,113*c* are spaced apart from each other to define a cavity therebetween which is for the vertical wall 40. Projections 116, 117 preferably are provided at the end of each core 113*b*,113*c*, and form the upper openings (such as those openings 37,37*a*) in the shank end 19. Although the additional cores forming the shank are not shown, they may be provided and constructed similar to the cores 113*b*,113*c*, and may form the lower openings in the shank 14. The cores 113*b*,113*c*, and lower cores not shown, also are configured to form the shank mid wall 25,25*a*, and the double I-beam structure shown and described herein. The cores 113*a*,113*b*,113*c* and lower cores (not shown), may be locked into the mold parts, such as the drag 111 (and/or the cope, not shown) to minimize or eliminate shifting during the molding process.

According to a preferred embodiment, the core structure 113 preferably forms the coupler shank 14, and when the cores, such as, for example, those cores 113*a*,113*b*,113*c* and lower cores (not shown) of the illustrated core configuration, are arranged in the mold 110 or with the other mold parts, form the shank openings (such as, for example, the openings 31,32,33,34,35,36 and 37,38, and 31*a*,32*a*,33*a*,34*a*,36*a* and 37*a*,38*a*) and shank mid wall (such as, for example, the wall 25 and wall 25*a*) and shank vertical wall (such as, for example, the vertical wall 40 and wall 40*a*). The cores 113*b*,113*c* illustrate a preferred embodiment where the cores are fixed to the mold 110, and in particular the drag 111, with fingers 114,115,116,117 projecting into the coupler space to define openings and ribs or walls.

The core structure 113 is shown with a plurality of fingers or projections 114,115,116,117 that intrude into the mold pattern and form the openings in the coupler shank (such as those openings 31,32,33,34,35,36,37,38, and the openings on the opposite side thereof 31*a*,32*a*,33*a*,34*a*,36*a*,37*a*,38*a*, the opening on the opposite side of opening 35 not shown in the figures). The core structure 113 preferably may be locked or otherwise fixed to the mold 110. The mold part, including the drag 111, the cope (not shown) and core structure 113 locked thereto, preferably form the coupler 10, and, in particular, the coupler shank 14 without detached core portions that may otherwise shift during the molding process. The illustrations in FIGS. 11 and 12 show voids between the core structure 113 and cores 113*a*,113*b*,113*c*, 114,115,116,117, which is where the molten material will fill when introduced into the mold 110. In addition, although not shown, other components for casting that may be used include risers, a box for holding the mold 110, and other components that may be used in connection with molding where molten metal or the melt is introduced into a mold. The coupler head 13 and internal head cavity 39 preferably may be formed in a customary fashion.

The coupler 10 is also shown with an optional lower shelf 85, which may be molded with or as part of the coupler head 13.

According to some preferred embodiments, the wall thickness range of the coupler walls may be from about 0.25 to about 3.0 inches. The coupler 10, according to some preferred embodiments, has walls that include at least some wall thicknesses that have thicknesses less than 1 inch, and more preferably, as small as 0.25 inches, or 0.5 inches. For example, the coupler 10 may be produced having a minimum wall thickness where the guard arm wall 18 (e.g., the wall forming the gathering face 18*a*) may be 0.5 inches or less (as may the guard arm side wall 17), and wherein the shank 14 of the coupler 10 has walls that are 0.5 inches or less, which may include walls comprising the shank mid portion 20, or walls comprising the shank end portion 19, or both. For example, a preferred range for the mid wall 25 (and mid wall portions 25*a*,25*b*) may be less than 2.0 inches, and preferably, less than 1 inch, and more preferably, between about 0.375 and 0.875 inches. The vertical wall 40 (and wall portion 40*a*) also may have a preferred thickness range, which may be less than 2.0 inches, and preferably, less than 1 inch, and more preferably, between about 0.375 and 0.875 inches.

According to a preferred embodiment, the coupler 10 may be constructed so that at least some of the coupler walls have a thickness at least as small as 0.5 inches. FIGS. 7 and 9 illustrate a preferred coupler configuration at the shank end portion 19. The upper openings 37,37*a* are shown extending into the coupler 10. The vertical wall portion 40*a* connects with the end wall 59*a* forming the end 59 of the coupler 10, and connects with the wall portion 69 defining the rear portion of the key slot 58. According to preferred embodiments, the coupler walls may be designated by measuring the diameter of a sphere that fits within the wall thickness. For example, the sphere represented by reference numeral 90 is shown to represent a maximum wall thickness ("A") at the location of the shank end portion 19, and at the coupler or shank end wall 59*a*. In comparison, the prior art, illustrated in FIGS. 8 and 10, shows a prior art coupler shank end portion 1000 having a maximum thickness, as measured by the sphere 1003 and its diameter "B", to be 4 inches. In the coupler end portion 19 shown in FIGS. 7 and 9, portion of the wall 59*a* and wall 40*a* are included in the area of the sphere 90, and the wall thickness, as designated by the sphere 90 is the diameter "A".

While the invention has been described with reference to specific embodiments, the description is illustrative and is not to be construed as limiting the scope of the invention. For example, although the core structure 113 used for forming the shank 14 has been shown and described being comprised of five components or five cores, greater or lesser numbers of components or cores may be used. In addition, while preferred embodiments are illustrated, according to some alternate embodiments, the openings and walls forming the double I-beam structure may be of different sizes from other openings or other walls. The openings provided in the coupler shank (and at other locations, such as the coupler head and guard arm), may be curved at their edges to facilitate molding and removal of the cores. Alternatively, the openings may be formed using right angle edges. Various modifications and changes may occur to those skilled in the art without departing from the spirit and scope of the invention described herein and as defined by the appended claims.

What is claimed is:

1. A railway vehicle coupler comprising:

(a) a head;

(b) a shank;

(c) said shank having a shank end portion and a shank mid portion, said shank end portion comprising a coupler end;

(d) said shank mid portion connecting said head with said shank end portion;

(e) said shank having an upper wall and a lower wall;

(f) at least one mid wall disposed between said upper wall and said lower wall; and (g) a key slot provided transversely through said shank at a location between said coupler head and said coupler end;

(h) wherein said head includes a guard arm having an upper wall, a lower wall and a mid-wall, wherein said shank end has an upper wall, a lower wall, and a mid-wall; and (i) wherein said head guard arm mid wall, said shank mid portion mid wall, and said shank end portion mid wall are longitudinally aligned.

2. The coupler of claim 1, wherein said mid-wall forms a portion of a double I-beam structure having a first I-beam portion with an upper horizontal portion and a lower horizontal portion and a second I-beam portion with an upper horizontal portion and a lower horizontal portion, wherein said upper wall comprises the upper horizontal portion of the first I-beam portion of said double I-beam, wherein said lower wall comprises the lower horizontal portion of the second I-beam portion of said double I-beam, and wherein said mid wall forms the lower horizontal portion of the first I-beam portion of said double I-beam, and wherein said mid-wall forms the upper horizontal portion of the second I-beam portion of said double I-beam.

3. The coupler of claim 2, wherein said double I-beam structure has a first leg extending between said upper wall and said mid wall, and a second leg extending between said mid wall and said lower wall.

4. The coupler of claim 3, wherein said first leg and said second leg are aligned in a linear relationship.

5. The coupler of claim 3, wherein said first leg and said second leg are aligned in a parallel relationship.

6. The coupler of claim 3, wherein said mid wall forms a plurality of double I-beam structures in said shank mid portion.

7. The coupler of claim 3, including reinforcing ribs, wherein said reinforcing ribs connect with said mid wall and at least one of said upper wall and said lower wall.

8. The coupler of claim 2, including reinforcing ribs connecting with said double I-beam structure.

9. The coupler of claim 1, wherein said coupler has an end at said shank end portion, wherein said mid wall includes a first mid wall portion between said coupler head and said key slot, and wherein said mid wall includes a second portion between said key slot and said coupler end.

10. The coupler of claim 1, wherein said mid wall includes a mid wall portion between said coupler head and said key slot.

11. The coupler of claim 1, wherein said mid wall includes a mid wall portion between said key slot and said coupler end.

12. The coupler of claim 1, wherein said coupler shank mid portion has openings on each side thereof.

13. The coupler of claim 12, wherein said openings extend into the coupler and are located between the upper wall and the lower wall.

14. The coupler of claim 12, wherein said mid wall connects with said upper wall and said lower wall.

15. The coupler of claim 12, wherein said shank end portion has a plurality of openings on each side thereof.

16. The coupler of claim 12, wherein said shank end portion has a plurality of openings on each side thereof; and wherein said shank end openings extend into the coupler and are located between the upper wall and the lower wall.

17. The coupler of claim 1, wherein said mid shank portion includes a longitudinal vertical wall.

18. The coupler of claim 1, wherein a plurality of openings are provided in said coupler head.

19. The coupler of claim 1, wherein said coupler is made from austempered ductile iron.

20. A railway vehicle coupler comprising:

(a) a head;

(b) a shank;

(c) said shank having a shank end portion and a shank mid portion;

(d) said shank mid portion connecting said head with said shank end portion;

(e) said shank having an upper wall and a lower wall;

(f) at least one mid wall disposed between said upper wall and said lower wall;

(g) wherein said head includes a guard arm having an upper wall, a lower wall and a mid wall, wherein said shank end has an upper wall, a lower wall, and a mid wall; and (h) wherein said head guard arm mid wall, said shank mid portion mid wall, and said shank end portion mid wall are longitudinally aligned.

21. The coupler of claim 20, wherein said coupler shank mid portion has openings on each side thereof.

22. The coupler of claim 21, wherein said openings extend into the coupler and are located between the upper wall and the lower wall.

23. The coupler of claim 21, wherein said mid wall connects with said upper wall and said lower wall.

24. The coupler of claim 21, wherein said shank end portion has a plurality of openings on each side thereof.

25. The coupler of claim 21, wherein said shank end portion has a plurality of openings on each side thereof; and wherein said shank end openings extend into the coupler and are located between the upper wall and the lower wall.

26. The coupler of claim 25, wherein said shank has a shank end portion mid wall, and wherein said openings are provided above and below said mid wall.

27. The coupler of claim 26, wherein said coupler is made from austempered ductile iron.

28. The coupler of claim 21, including a mold for forming said coupler, said mold including a plurality of mold parts, wherein said plurality of mold parts include at least a core for forming said openings on each side of said shank mid portion.

29. The coupler of claim 20, wherein said mid shank portion includes a longitudinal vertical wall.

30. The coupler of claim 29, wherein at least a portion of said vertical wall forms an exterior surface of said coupler.

31. The coupler of claim 30, wherein said vertical wall has a first side comprising an exterior surface of the first shank side, and a second side comprising an exterior surface of the second shank side.

32. The coupler of claim 29, wherein said shank has a first side and a second side, wherein said vertical wall comprises a first exterior surface of the coupler at at least said first shank side, and a second exterior surface of the coupler at at least said second shank side.

33. The coupler of claim 29, wherein said vertical wall joins with said front wall.

34. The coupler of claim 20, wherein a plurality of openings are provided in said coupler head.

35. The coupler of claim 34, wherein said coupler head has a guard arm portion, and wherein at least some of said plurality of said coupler head openings are provided in said guard arm portion.

36. The coupler of claim 20, the coupler head portion configured to couple to a first coupler knuckle for coupling the railcar coupler to a second railcar coupler of an adjacent railcar;

the coupler head portion comprising a nose portion and a gathering face extending from the nose portion for engaging a second coupler knuckle coupled to the second railcar coupler;

the gathering face comprising a gathering face wall.

37. The coupler of claim 36, wherein said upper wall, said lower wall, said mid wall and said gathering face wall have thicknesses between 0.25 and 3.0 inches.

38. The coupler of claim 37, wherein said austempered ductile iron comprises ductile iron alloyed with one or more metals selected from the group consisting of nickel, molybdenum, manganese, copper and mixtures thereof, and wherein said ductile iron alloyed with said one or more said metals is iron that has been austempered with said one or more metals to produce said vehicle coupler.

39. The coupler of claim 20, wherein said coupler is made from austempered ductile iron.

40. The coupler of claim 20, including a front wall, and wherein the head joins with the shank at the front wall.

41. The coupler of claim 40, wherein said mid wall joins with said front wall.

42. The coupler of claim 41, wherein said vertical wall joins with said front wall.

43. The coupler of claim 20, wherein said upper wall, said lower wall and said mid wall have thicknesses between 0.25 and 3.0 inches.

44. The coupler of claim 20, wherein the coupler is constructed from grade E steel.

45. The coupler of claim 20, wherein said coupler has an end at said shank end portion, wherein said coupler has a key slot therein provided transversely through said shank, wherein said mid wall includes a first mid wall portion between said coupler head and said key slot, and wherein said mid wall includes a second portion between said key slot and said coupler end.

* * * * *